US012471651B2

(12) United States Patent
Xu et al.

(10) Patent No.: US 12,471,651 B2
(45) Date of Patent: Nov. 18, 2025

(54) TOP WORN GARMENT WITH BUILT-IN SHAPEWEAR

(71) Applicant: XIAMEN HEXIN INTERNATIONAL TRADE CO., LTD., Fujian (CN)

(72) Inventors: Zhennan Xu, Fujian (CN); Huijuan Lin, Fujian (CN)

(73) Assignee: XIAMEN HEXIN INTERNATIONAL TRADE CO., LTD., Xiamen (CN)

( * ) Notice: Subject to any disclaimer, the term of this patent is extended or adjusted under 35 U.S.C. 154(b) by 154 days.

(21) Appl. No.: 18/488,934

(22) Filed: Oct. 17, 2023

(65) Prior Publication Data

US 2025/0064152 A1 Feb. 27, 2025

(30) Foreign Application Priority Data

Aug. 23, 2023 (CN) ..... 202322270842.6

(51) Int. Cl.
*A41B 1/00* (2006.01)
*A41D 1/04* (2006.01)
*A41D 27/00* (2006.01)

(52) U.S. Cl.
CPC ..... *A41D 27/00* (2013.01); *A41B 1/00* (2013.01); *A41D 1/04* (2013.01)

(58) Field of Classification Search
CPC ..... A41D 2400/38; A41D 1/18; A41D 27/00; A41D 1/04; A41C 1/006; A41B 1/00
See application file for complete search history.

(56) References Cited

U.S. PATENT DOCUMENTS 1,667,161 A * 4/1928 Kosofsky ..... A41B 1/04 2/77
1,887,926 A * 11/1932 Fox ..... A41B 9/08 2/77
2,018,666 A * 10/1935 Flesh ..... A41B 1/06 2/78.2
2,033,456 A * 3/1936 Cunningham ..... A41D 7/00 2/67
2,062,596 A * 12/1936 Monette ..... A41B 9/08 D2/714
D135,815 S * 6/1943 Seham ..... D2/849
2,381,232 A * 8/1945 Stone ..... A41C 1/006 D2/704
2,450,631 A * 10/1948 Buchler ..... A41D 11/00 2/80

(Continued)

FOREIGN PATENT DOCUMENTS

CN 104799445 A 7/2015

*Primary Examiner* — Richale L Quinn

(57) ABSTRACT

The present disclosure relates to the technical field of clothing, in particular to a top with a built-in shapewear. The top with the built-in shapewear includes an outer garment and an inner garment, the outer garment is of a top structure, the inner garment is of a one-piece pants structure or a high-waisted pants structure and has a shaping portion used for applying a tightening force, a junction of a lower hem of the outer garment and the inner garment is located in a region three centimeters above and below a waistline of the inner garment, and an upper end of the outer garment is freely separated from the inner garment. The shapewear in the present disclosure can not only realize a body shaping function, but also make the lower hem of the outer garment of the top neat, ordered and not messy.

6 Claims, 11 Drawing Sheets

(56) References Cited

U.S. PATENT DOCUMENTS 2,477,593 A * 8/1949 Gershenow ..... A41B 9/04 450/103
2,579,547 A * 12/1951 Cadous ..... A41C 1/006 D2/702
2,597,587 A * 5/1952 Lustgarten ..... A41B 9/04 450/103
2,789,290 A * 4/1957 Mayer ..... A41B 9/12 2/77
3,840,900 A * 10/1974 Cruz ..... A41B 1/04 2/408
4,184,494 A * 1/1980 King, Jr. ..... A41D 13/0017 450/95
5,033,121 A * 7/1991 Larsen ..... A41B 9/008 2/115
5,060,315 A * 10/1991 Ewing ..... A41B 9/005 2/400
5,206,957 A * 5/1993 Gulick ..... A41D 13/1236 2/84
5,283,908 A * 2/1994 Martin ..... A41D 13/0017 2/408
5,625,898 A * 5/1997 Telega ..... A41B 1/04 2/78.2
6,061,832 A * 5/2000 Morrison, Jr. ..... A41B 9/00 2/70
6,817,034 B2 * 11/2004 Smilovic ..... A41D 1/21 2/73
D571,081 S * 6/2008 Galvan ..... D2/841
D595,480 S * 7/2009 Giugliano ..... D2/702
8,568,195 B1 * 10/2013 Schindler ..... A41C 1/06 450/33
8,574,026 B2 * 11/2013 Livingstone ..... A41D 31/18 450/33
D723,768 S * 3/2015 Khaitan ..... D2/714
9,433,250 B2 * 9/2016 Merchen ..... A41F 17/00
9,717,289 B1 * 8/2017 Fooden ..... A41D 7/00
10,085,503 B2 * 10/2018 Peral ..... A41B 9/08
D848,118 S * 5/2019 Pettaway ..... D2/745
10,415,163 B2 * 9/2019 Carney ..... D04B 1/246
10,709,177 B2 * 7/2020 Shoemaker ..... A41B 9/04
D906,634 S * 1/2021 Pettaway ..... D2/745
10,881,152 B2 * 1/2021 Melendez ..... A41C 5/005
10,959,465 B2 * 3/2021 Melendez ..... B32B 7/09
11,178,925 B2 * 11/2021 Fischer ..... A41D 13/0015
11,350,676 B1 * 6/2022 Law ..... A41F 17/00
11,357,271 B2 * 6/2022 Mason ..... A61F 13/148
11,445,768 B1 * 9/2022 Dehlsen ..... A41C 3/0028
D1,002,148 S * 10/2023 Xu ..... D2/714
11,857,011 B2 * 1/2024 Solano ..... A41D 7/00
12,059,044 B2 * 8/2024 Shams ..... A41D 1/14
2006/0166600 A1 * 7/2006 Ravoiu ..... A41C 1/06 450/7
2006/0277663 A1 * 12/2006 King ..... A41B 9/08 2/406
2010/0184355 A1 * 7/2010 Kennedy ..... A41C 1/06 66/171
2011/0126341 A1 * 6/2011 Soriano ..... A41B 1/04 2/116
2015/0272231 A1 * 10/2015 Mendicino ..... A41B 1/04 450/30
2016/0007657 A1 * 1/2016 Manhal ..... A41B 9/08 2/79
2016/0015088 A1 * 1/2016 Hendrickson ..... A41C 1/06 450/95
2019/0029346 A1 * 1/2019 Peral ..... A41F 17/00
2019/0116898 A1 * 4/2019 Ulrich ..... A41C 3/08
2019/0246717 A1 * 8/2019 Fischer ..... A41D 27/00
2019/0364977 A1 * 12/2019 Sabag ..... A41D 1/22
2019/0364978 A1 * 12/2019 Taylor ..... A41B 9/08
2021/0186132 A1 * 6/2021 Solano ..... A41D 31/14
2022/0151308 A1 * 5/2022 Penfield ..... A41C 1/003
2022/0378119 A1 * 12/2022 Obarrio ..... A41D 7/00
2024/0108085 A1 * 4/2024 Shams ..... A41C 1/06
2024/0114977 A1 * 4/2024 Caceres ..... A41B 9/007

* cited by examiner

TOP WORN GARMENT WITH BUILT-IN SHAPEWEAR

TECHNICAL FIELD

The present disclosure relates to the technical field of clothing, in particular to a top with a built-in shapewear.

BACKGROUND

Tops, a type of clothing worn on the upper body, including shirts, T-shirts, vests, and the like, are generally constructed as a single layer and do not have a body shaping function, and if a body shaping effect is to be achieved, a corset is required to be worn inside or an inner corset is sewn on the inside of a top. For example, the Chinese published patent document (CN104799445A) discloses a top with a hidden control lining, where an inner corset and an outer garment are sewn and connected together at a neckline and armholes by stitching. However, this type of singlet clothing emphasizes a traceless effect that an outer garment covers an inner garment completely to make the inner garment invisible, so that the coverage area of the outer garment has to be large enough, which in turn makes a lower hem of the outer garment longer, exposing the lower hem is not beautiful, and the lower hem needs to be arranged in place if put into a crotch of pants to achieve a beautiful effect.

SUMMARY

The present disclosure aims to provide a top with a built-in shapewear, which has a body shaping function while eliminating the need for arranging a lower hem.

In order to achieve the foregoing objective, the technical solution adopted by the present disclosure is as follows:

The top with the built-in shapewear includes an outer garment and an inner garment, the outer garment is of a top structure, the inner garment is of a one-piece pants structure or a high-waisted pants structure and has a shaping portion used for applying a tightening force, a junction of a lower hem of the outer garment and the inner garment is located in a region three centimeters above and below a waistline of the inner garment, and an upper end of the outer garment is freely separated from the inner garment.

Preferably, the top structure is a shirt, a T-shirt, a blouse, or a vest.

Preferably, a collar type of the top structure is a crossed V-neck type, a deep V-neck type, a round neck type, a square neck type, a U-neck type, a camisole neck type, a halter neck type, a one-shoulder neck type, or a chest wrap neck type.

Preferably, the outer garment is made of an elastic fabric.

Preferably, the inner garment includes a pants body portion and an upper body portion connected to the pants body portion, and a corresponding front abdominal region of the inner garment is provided as an abdomen binding and shaping portion.

Preferably, the upper body portion further includes a cup portion.

Preferably, the inner garment includes a pants body portion, and a pants type of the pants body portion is thongs, a brief, a boxer brief, fourth pants, or fifth pants.

Preferably, a hip lifting piece is disposed at a position of the pants body portion corresponding to a lower part of hips.

Preferably, the inner garment includes a pants body portion, the pants body portion includes a front crotch piece, a back crotch piece, and a hip lifting belt, the front crotch piece and the back crotch piece form a shape of thongs, the hip lifting belt and left and right ends of an upper portion of the front crotch piece of the pants body portion are connected by a first bra extender assembly, a bottom end of the hip lifting belt is connected to a bottom end of the front crotch piece by a second bra extender assembly and is connected to a bottom end of the back crotch piece in a sewing mode, and the hip lifting belt is wound from a bottom end of a gluteal fold outwards so that a hip lifting and shaping portion is formed at a position corresponding to a lower part of hips.

Preferably, the inner garment includes a pants body portion and an upper body portion connected to the pants body portion, the upper body portion and the pants body portion are seamlessly woven into one piece or sewn by stitching or attached together, and a lower hem of the outer garment is fixed to the inner garment by a connecting belt in a sewing or attaching mode.

Compared with the prior art, the present disclosure has the following beneficial effects:

According to the present disclosure, the shapewear is combined and disposed inside the top, and the shapewear adopts the high-waisted pants structure or the one-piece pants structure and is provided with the shaping portion, so as to realize the body shaping function: for example, the abdomen binding and shaping portion can squeeze and tighten flab of the whole abdomen of a wearer and flatten abdominal fat, so as to play a role in tightening the abdomen; and the hip lifting and shaping portion can gather and lift the flab and fat of the hips of a person upwards, so as to shape the rounded and lifted hips, and thus play a role of lifting the hips of a user.

In addition, the lower hem of the outer garment of the top according to the present disclosure is combined with and fixed to the inner garment, so as to realize good hemming treatment of the lower hem, eliminate a process of arranging the lower hem of the top during wearing and achieve a beautiful effect, and make the lower hem of the outer garment of the top neat, ordered and not messy.

The pants body portion and the upper body portion of the inner garment according to the present disclosure may be sewn or attached together or seamlessly woven into a one-piece structure, when the pants body portion and the upper body portion are sewn or attached together, a first combination site of the pants body portion and the upper body portion is in the region three centimeters above and below the waistline to be matched with a length of the outer garment of the top, the first combination site is above the waistline when the top is short while the first combination site is below the waistline when the top is long, and the first combination site corresponds to the waistline when the top is normal in length, so that the inner garment is applicable to tops of different lengths, and types of the tops include shirts, T-shirts, vests, blouses, and the like.

In addition, the lower hem of the outer garment of the top is combined and fixed to the inner garment by the connecting belt, the connecting belt has a width greater than a width of a sewing combination portion formed by the first combination site, the connecting belt covers the first combination site from the bottom to the top in the upwardly wearable state, a second combination site between the connecting belt and the lower hem of the outer garment is above the first combination site, and the sewing combination portion formed by sewing the pants body portion to the upper body portion cannot be seen in appearance, so as to enhance the aesthetics and smoothness of the combination between the outer garment and the inner garment and the combination between the upper body portion and the pants body portion of the inner garment, and also improve the wearing comfort.

Figure 1:
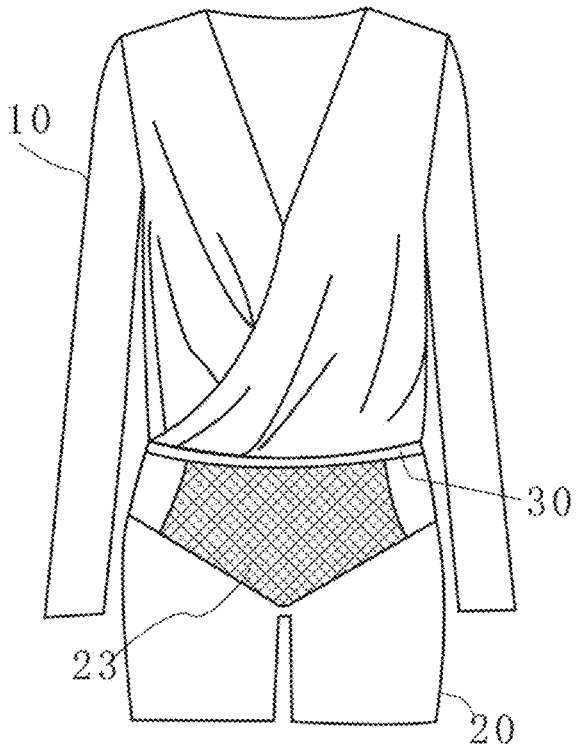
FIG. 1 is a schematic diagram of a front structure according to Embodiment 1 of the present disclosure.
Figure 2:
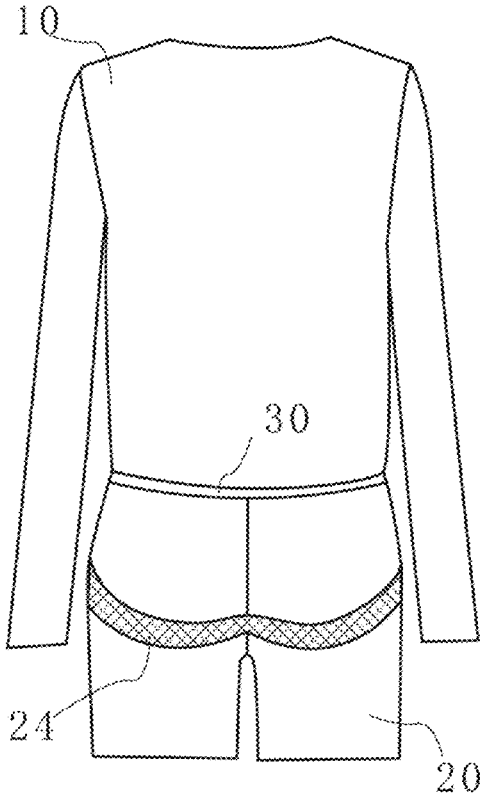
FIG. 2 is a schematic diagram of a back structure according to Embodiment 1 of the present disclosure.
Figure 3:
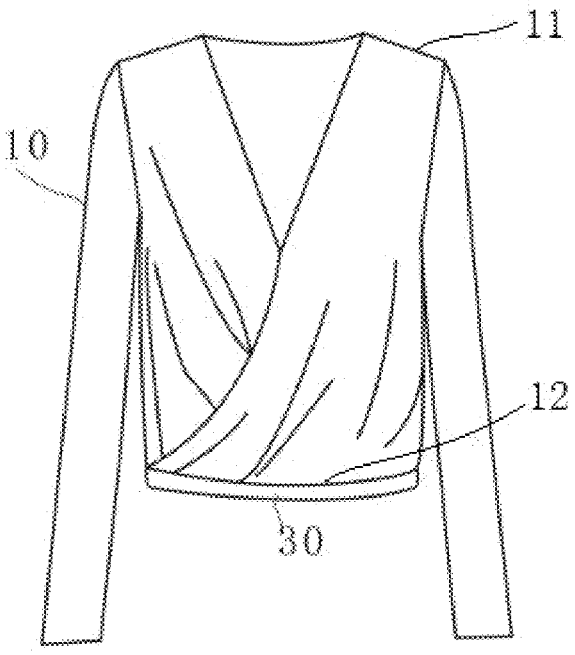
FIG. 3 is a schematic structural diagram of a crossed V-neck shirt according to the present disclosure.
Figure 4:
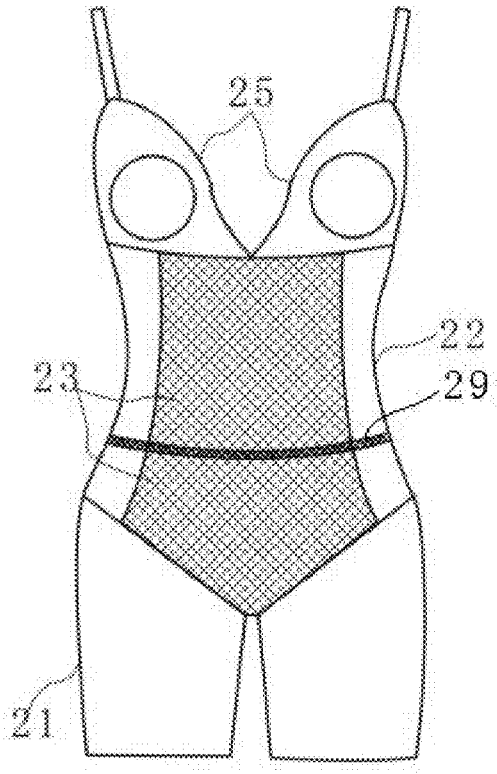
FIG. 4 is a schematic diagram of a front structure of an inner garment according to Embodiment 1 of the present disclosure.
Figure 5:
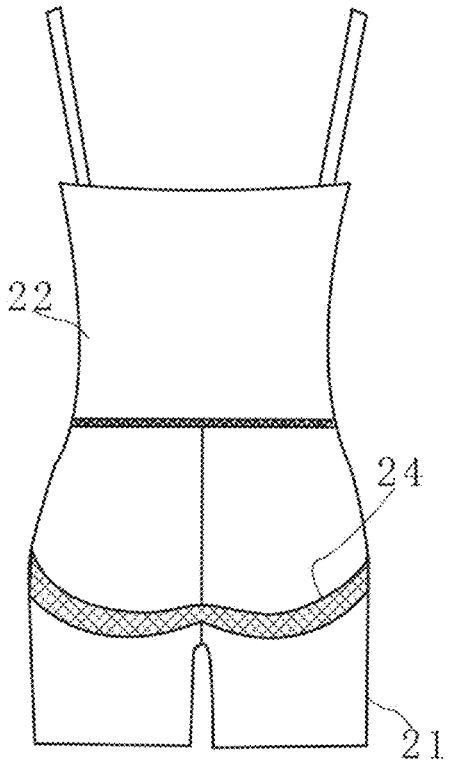
FIG. 5 is a schematic diagram of aback structure of an inner garment according to Embodiment 1 of the present disclosure.

Reference numerals in drawings: 10, outer garment; 11, upper end of the outer garment; 12, lower end of the outer garment; 20, inner garment; 21, pants body portion; 22, upper body portion; 23, abdomen binding and shaping portion; 24, hip lifting piece; 25, cup portion; 26, front crotch piece; 27, back crotch piece; 28, hip lifting belt; 29, first combination site; and 30, connecting belt.

DETAILED DESCRIPTION

In order to make the above features and advantages of the present disclosure more obvious and easier to understand, the following embodiments are specially cited, and with the accompanying drawings, are described in detail as follows.

Embodiment 1

As shown in FIGS. 1 to 5, the present embodiment provides a top with a built-in shapewear, including an outer garment 10 and an inner garment 20, a junction of a lower hem of the outer garment 10 and the inner garment 20 is located in a region three centimeters above and below a waistline of the inner garment 20, and an upper end of the outer garment 10 is freely separated from the inner garment 20.

In the present embodiment, the inner garment 20 is of a suspender one-piece pants structure and includes a pants body portion 21 and an upper body portion 22 connected to the pants body portion 21, the upper body portion 22 and the pants body portion 21 are sewn together by stitching to form a first combination site. In some other examples, the upper body portion 22 and the pants body portion 21 are seamlessly woven into a whole or attached together by adhesives.

The pants body portion 21 has a pants type of fourth pants, the back of the fourth pants is provided with a hip lifting piece 24 at a position corresponding to the lower part of the hips, and the hip lifting piece 24 gathers and lifts upwardly the flab, fat, and the like of the hips of a person, so as to shape the rounded and lifted hips, thereby playing a role in lifting the hips for a user. In order to facilitate toileting, a crotch bottom adopts an overlapping crotch structure, specifically including a left crotch piece and a right crotch piece, and the left crotch piece and the right crotch piece are overlapped together and are closed, but can be separated from each other and staggered under the action of external force to be in an open state.

In addition, the front of the pants body portion 21 is provided with a first abdomen binding region corresponding to a pubis region, and a corresponding front abdominal region of the upper body portion 22 is provided as a second abdomen binding region, the second abdomen binding region and the first abdomen binding region are connected to jointly form an abdomen binding and shaping portion 23 of the inner garment. The first abdomen binding region and the second abdomen binding region have a coefficient of strength greater than that of surrounding regions, and preferably, the first abdomen binding region, the second abdomen binding region, and the hip lifting piece 24 adopt a double-layered body shaping fabric structure, while other regions of the inner garment 20 adopt a single-layered body shaping fabric structure.

In addition, in order to increase the function of not wearing an underwear as well as a breast enhancement function, the upper body portion 22 of the inner garment 20 of the present embodiment further includes a cup portion 25, and the cup portion 25 may be made of a double-layered brocade-spandex fabric and are removably provided with cup pads therein.

In the present embodiment, the outer garment 10 is a crossed V-neck shirt structure, and made of an elastic fabric such as a brocade-spandex fabric. In some other examples, the outer garment 10 may also be a T-shirt, a vest, or a blouse with elasticity, and a collar type is unlimited, and may be a crossed V-neck type, a deep V-neck type, a round neck type, a square neck type, a U-neck type, a camisole neck type, a halter neck type, a one-shoulder neck type, or a chest wrap neck type. Different types and collar types of tops can enrich the outlooking of the outer garment.

In the present embodiment, a first combination site between the pants body portion 21 and the upper body portion 22 of the inner garment 20 is correspondingly located at the waistline, and a sewing combination portion formed by sewing is disposed outwardly and away from the skin, thereby reducing friction discomfort on the skin from the sewing combination portion. In addition, a lower hem of a crossed V-neck shirt of the present embodiment is fixed to the inner garment 20 by sewing through a connecting belt 30. Specifically, one end of the connecting belt 30 and the pants body portion 21 below the first combination site are sewn while the other end of the connecting belt 30 and the lower hem of the outer garment 10 are sewn to form a second combination site, the connecting belt 30 has a width of 1 cm to 2 cm, the connecting belt 30 covers the first combination site from the bottom to the top in the upwardly wearable state, the second combination site between the connecting belt 30 and the lower hem of the outer garment 10 is above the first combination site, and the sewing combination portion formed by sewing the pants body portion 21 to the upper body portion 22 cannot be seen in appearance, so as to enhance the aesthetics and smoothness of the combination between the outer garment 10 and the inner garment 20 and the combination between the upper body portion 22 and the pants body portion 21 of the inner garment 20, and also improve the wearing comfort.

Embodiment 2

Figure 6:
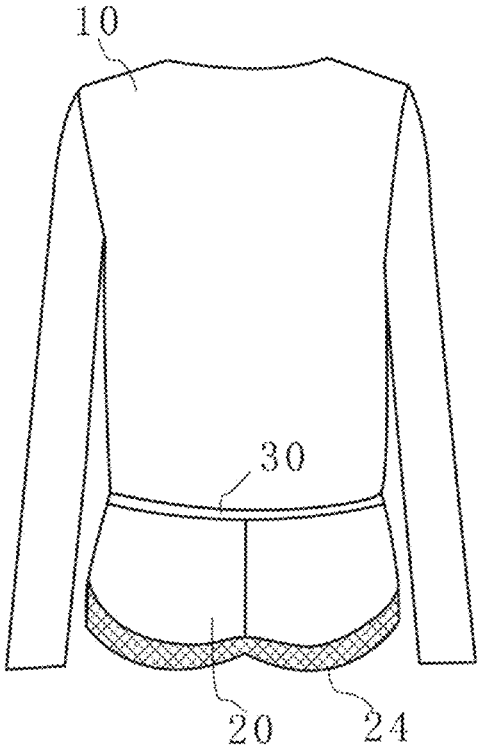
FIG. 6 is a schematic diagram of aback structure according to Embodiment 2 of the present disclosure.

This embodiment differs from Embodiment 1 above only in that a pants body portion 21 of an inner garment 20 is boxer briefs while a crotch bottom is of a bra extender removable structure, as shown in FIG. 6.

Embodiment 3

Figure 7:
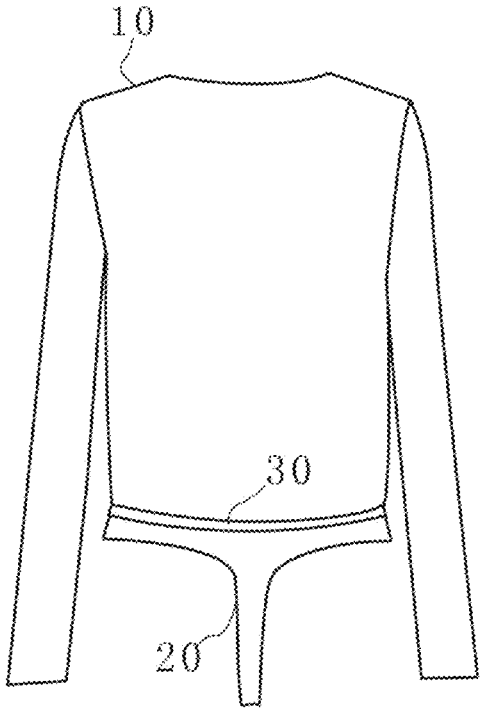
FIG. 7 is a schematic diagram of aback structure according to Embodiment 3 of the present disclosure.

This embodiment differs from Embodiment 1 above only in that a pants body portion 21 of an inner garment 20 is thongs while a crotch bottom is of a bra extender removable structure without a hip lifting piece, as shown in FIG. 7.

Embodiment 4

Figure 8:
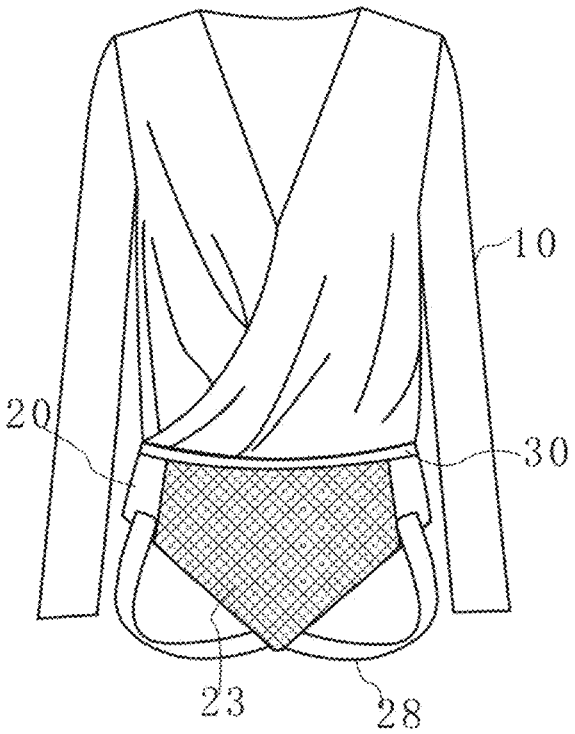
FIG. 8 is a schematic diagram of a front structure according to Embodiment 4 of the present disclosure.
Figure 9:
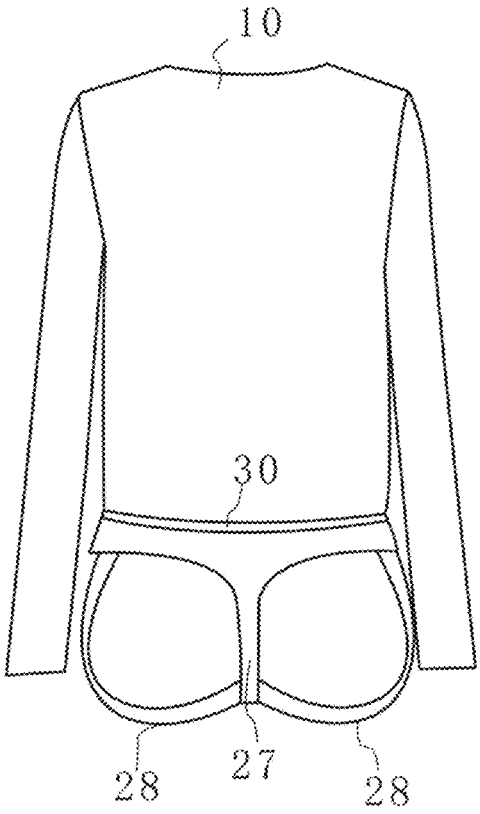
FIG. 9 is a schematic diagram of aback structure according to Embodiment 4 of the present disclosure.
Figure 10:
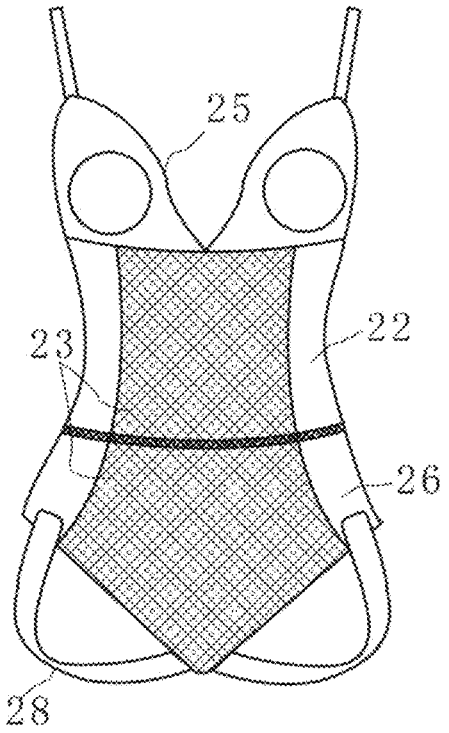
FIG. 10 is a schematic diagram of a front structure of an inner garment according to Embodiment 4 of the present disclosure.

As shown in FIGS. 8 to 10, this embodiment differs from Embodiment 1 above only in a pants body portion 21, the pants body portion 21 of the inner garment 20 of the present embodiment includes a front crotch piece 26, a back crotch piece 27, and a hip lifting belt 28, the front crotch piece 26 and the back crotch piece 27 form a thongs shape, a hollowed-out structure is formed at a position corresponding to the hips and prevents the shaping fabric from being too tight and flattening the hips, thereby being applicable to different hiplines, and the shaping effect and universality of products are improved.

The hip lifting belt 28 and left and right ends of an upper portion of the front crotch piece 26 of the pants body portion 21 are connected by a first bra extender assembly, a bottom end of the hip lifting belt 28 is connected to a bottom end of the front crotch piece 26 by a second bra extender assembly and is connected to a bottom end of the back crotch piece 27 in a sewing mode, and the hip lifting belt 28 is wound from a bottom end of a gluteal fold outwards so that a hip lifting and shaping portion is formed at a position corresponding to a lower part of hips, so as to gather and lift upwardly the flab, fat, and the like of the lower part of the hips of a person, thereby shaping the rounded and lifted hips, and playing a role in lifting the hips for a user.

The second bra extender assembly is capable of combining and fixing the hip lifting belt 28 to the front crotch piece 26 to keep the crotch part of the person covered and protected, and unhooking the hip lifting belt 28 and the front crotch piece 26 to open the crotch part of the person for convenience of toileting of the user without the need for taking off any other portion, and the user can conveniently put on and take off the pants body portion.

Embodiment 5

Figure 11:
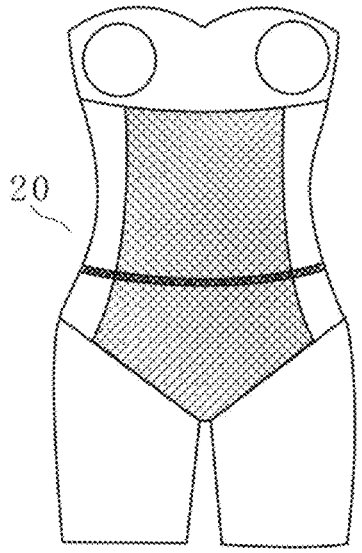
FIG. 11 is a schematic diagram of a front structure of an inner garment according to Embodiment 5 of the present disclosure.

This embodiment differs from Embodiment 1 above only in that an inner garment 20 is strapless one-piece pants without a camisole while other parts are the same as structures of corresponding parts of Embodiment 1, as shown in FIG. 11.

Embodiment 6

Figure 12:
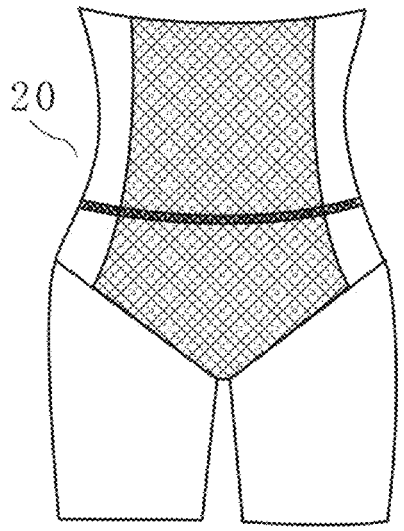
FIG. 12 is a schematic diagram of a front structure of an inner garment according to Embodiment 6 of the present disclosure.

This embodiment differs from Embodiment 1 above only in that, as shown in FIG. 12, an inner garment 20 is of a high-waisted pants structure, i.e., does not have a suspender or a cup portion, and an upper end of an upper body portion is located at the upper abdomen below the chest. Specifically, the inner garment 20 of this embodiment includes a pants body portion 21 and an upper body portion 22 connected to the pants body portion 21, the upper body portion 22 and the pants body portion 21 are sewn together by stitching to form a first combination site, and the first combination site is correspondingly located at a waistline.

The pants body portion 21 has a pants type of fourth pants, and the back of the fourth pants is provided with a hip lifting piece 24 at a position corresponding to the lower part of the hips, and the hip lifting piece 24 gathers and lifts upwardly the flab, fat, and the like of the hips of a person, so as to shape the rounded and lifted hips, thereby playing a role in lifting the hips for a user. A crotch bottom adopts an overlapping crotch structure for the convenience of toileting.

In addition, the front of the pants body portion 21 is provided with a first abdomen binding region corresponding to a pubis region, and a corresponding front abdominal region of the upper body portion 22 is provided as a second abdomen binding region, the second abdomen binding region and the first abdomen binding region are connected to jointly form an abdomen binding and shaping portion 23 of the inner garment 20. The first abdomen binding region and the second abdomen binding region have a coefficient of strength greater than that of surrounding regions, and preferably, the first abdomen binding region, the second abdomen binding region, and the hip lifting piece 24 adopt a double-layered body shaping fabric structure, while other regions of the inner garment 20 adopt a single-layered body shaping fabric structure.

The above shows and describes the basic principles, main features and the advantages of the present disclosure, and those skilled in the art should understand that the present disclosure is not limited by the above embodiments, the above embodiments and the description in the specification are only illustrative of the principles of the present disclosure, and various variations and improvements may be made for the present disclosure under the premise that it does not depart from the spirit and scope of the present disclosure, which fall within the scope of the present disclosure claimed to be protected, and the scope of the present disclosure claimed to be protected is as defined in the appended claims and equivalents thereof.

What is claimed is:

1. A top worn garment with a built-in shapewear, comprising an outer garment and an inner garment built in the outer garment, wherein the outer garment is a crossed V-neck shirt, the inner garment comprises a pants body portion and an upper body portion connected to the pants body portion, the upper body portion comprises a cup portion, and a corresponding front abdominal region of the inner garment is provided as an abdomen binding and shaping portion; a lower end of the outer garment is fixed to the inner garment with a connecting belt by sewing or attaching, the connecting belt covers a first combination site between the pants body portion and the upper body portion, and an upper end of the outer garment is freely separated from the inner garment.

2. The top worn garment with the built-in shapewear according to claim 1, wherein the outer garment is made of an elastic fabric.

3. The top worn garment with the built-in shapewear according to claim 1, wherein a pants type of the pants body portion is thongs, briefs, boxer briefs, four-tenths trousers, or five-tenths trousers.

4. The top worn garment with the built-in shapewear according to claim 3, wherein a hip lifting piece is disposed at a position of the pants body portion corresponding to a lower part of hips.

5. The top worn garment with the built-in shapewear according to claim 1, wherein the pants body portion comprises a front crotch piece, a back crotch piece, and a hip lifting belt, the front crotch piece and the back crotch piece form a shape of thongs, left and right ends of the hip lifting belt are respectively connected to left and right ends of an upper portion of the front crotch piece of the pants body portion, a bottom end of the hip lifting belt is connected to a bottom end of the front crotch piece and a bottom end of the back crotch piece by sewing, and the hip lifting belt is configured to wound from a bottom end of a gluteal fold outwards to form a hip lifting and shaping portion adapted for a lower part of hips.

6. The top worn garment with the built-in shapewear according to claim 1, wherein the upper body portion and the pants body portion are seamlessly woven into a whole or sewn by stitching or attached together.

* * * * *